United States Patent [19]

Tinsley

[11] 4,372,181

[45] Feb. 8, 1983

[54] COMPACT POWER WRENCHING MACHINE

[75] Inventor: James M. Tinsley, Round Rock, Tex.

[73] Assignee: N-S-W Corporation, Austin, Tex.

[21] Appl. No.: 205,386

[22] Filed: Nov. 10, 1980

[51] Int. Cl.[3] ..... B25B 13/46

[52] U.S. Cl. ..... 81/57.39; 74/128

[58] Field of Search ..... 81/57.39; 74/128, 142, 74/141.5

[56] References Cited

U.S. PATENT DOCUMENTS

| | | | |
|---|---|---|---|
| 3,587,365 | 6/1971 | DeGaston | 74/142 |
| 3,930,776 | 1/1976 | Keller | 81/57.39 |
| 4,137,800 | 2/1979 | Austin | 81/57.39 |
| 4,279,171 | 7/1981 | Fulling | 81/57.39 |

*Primary Examiner*—James L. Jones, Jr.

*Attorney, Agent, or Firm*—Michael P. Breston

[57] ABSTRACT

The compact power wrenching machine (10) has an elongated, rigid frame (11). A fluid-operated cylinder (20') having a reciprocating ram (20) is mounted at one end of the frame. A wrench (22), preferably a ratcheting-type, is rotatably mounted at the opposite end of the frame. A force-transferring mechanism (21) has a body which is movably mounted on the frame between the wrench and the ram. The ram is securely connected to the mechanism's body which supports the ratchet wrench for relative motion therebetween. In use, the body of the mechanism is moved by the ram, the ratchet wrench is rotated by the body of the mechanism, and the rotating wrench can also rotate a threaded fastener.

5 Claims, 8 Drawing Figures

L
10
2
2
12
13
14
15
17
18
19
20
20'
21
22
25
26
30
33
34
36
37
38
41
44
47
51
52
54

H
3
3
14
18
19
20
20'
21
22
26
32
33
34
36
36'
37
38
38'
41
42
43
44
45
45'
47
47a
48
49
49'
51
51a
52
54
55

12
15
19
41a
43
44
51
52

10
11
12
14
15
16
17
18
19
20
20'
21
22
25
26
30
31
32
33
34
35
36
37
38
38'
39
41
41a
41b
43
44
45'
47
47a
49
51
52
54
61
62
5
6

21
30
31
34
35
36
36'

12
15
16
37
38
38'
39
45'

FIG. 7.
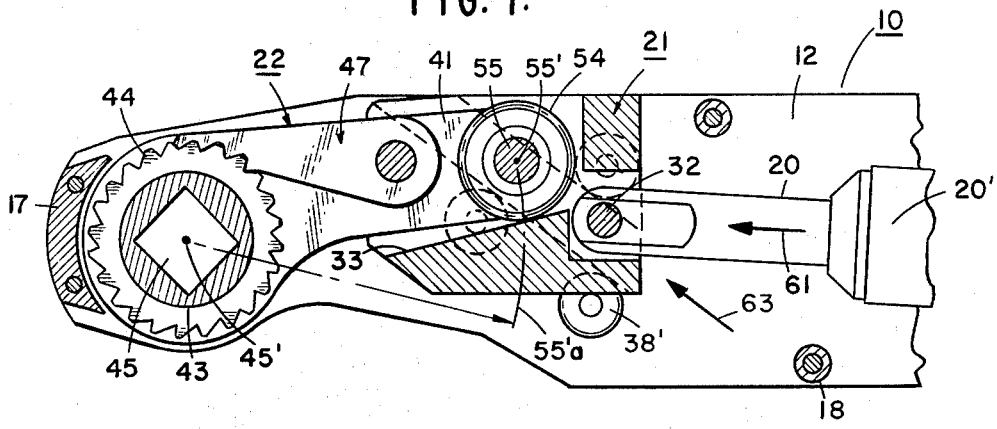
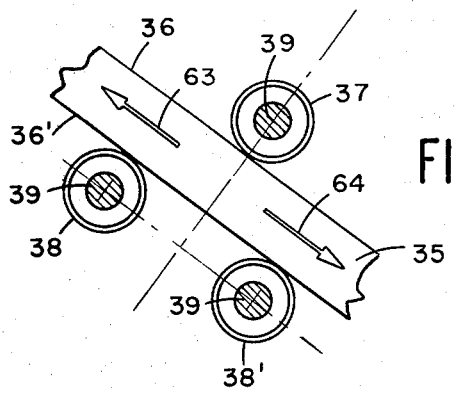
FIG. 8.

COMPACT POWER WRENCHING MACHINE

BACKGROUND OF THE INVENTION

1. Field of the Invention

This invention generally relates to power wrenching machines and more particularly to such machines that utilize a ratcheting-type wrench for turning threaded fasteners, such as nuts and bolts.

2. Description of the Prior Art

A power wrenching machine of the foregoing type is described in U.S. Pat. No. 4,091,890, assigned to the same assignee. The patented machine is now widely used on flanged and other connections having threaded fasteners. Other such machines are also known from U.S. Pat. Nos. 3,745,858 and 3,930,776.

The patented machines have in common a hydraulically-operated ram and a ratcheting-type wrench. The ram is directly and pivotably connected to the wrench for transmitting a perpendicular force to the wrench, as more fully explained in Column 3, Lines 37–63 of said U.S. Pat. No. 4,091,890.

In said patents U.S. Pat. Nos. 3,745,858 and 3,930,776 the ratchet wrench and the hydraulic ram are mounted on a common frame. Because of the long felt need to pivotably connect the ram to the wrench at an angle which is substantially 90°, it was also felt that the height of the machine could not be made less than the length of the employed wrench.

Hence, the height-to-length (H/L) ratio of such known machines is relatively substantial, and for that reason the machines cannot be used in installations providing limited access to their threaded fasteners which it is desired to rotate. In limited installations in which access to the threaded fasteners is available only through a very narrow channel, the tightening or loosening operations are now being carried out with improved tooling and by utilizing a considerable amount of hand labor.

Thus, the need for machines of the foregoing class having a relatively small H/L ratio has remained unfulfilled, and the drawbacks of known machines have been unsatisfactorily resolved.

It is an object of the present invention to provide such a rugged and dependable wrenching machine having a small H/L ratio. The height of the machine is substantially independent of the length of the wrench used within the machine. Its small height makes it possible for the novel machine to operate in installations wherein access to a threaded connector is available only through a narrow channel which is substantially parallel to or coincident with the head of the fastener to be rotated.

An additional object is to provide a new and improved power wrenching machine having a minimum of moving parts that are arranged in tandem along the length dimension of the machine, and are adapted to transfer high forces therebetween.

SUMMARY OF THE INVENTION

The compact power wrenching machine has an elongated, rigid frame. A fluid-operated cylinder having a reciprocating ram is mounted at one end of the frame. A wrench, preferably a ratcheting-type, is rotatably mounted at the opposite end of the frame. A force-transferring mechanism has a body which is movably mounted on the frame between the wrench and the ram. The ram is securely connected to the mechanism's body which supports the ratchet wrench for relative motion therebetween. In use, the body of the mechanism is moved by the ram, the ratchet wrench is rotated by the body of the mechanism, and the rotating wrench can also rotate a threaded fastener. In this manner, the moving mechanism changes the reciprocating linear stroke of the ram into a reciprocating rotational stroke by the wrench, as the mechanism moves relative to the wrench.

The preferred force-transferring mechanism is a wedge whose body has a sloping guide surface and a work surface which is preferably also sloping. The ram is pivotably connected to the rear end of the wedge, and the outer end of the ratchet wrench rolls on the work surface during the movements of the wedge.

The sloping guide surface guides the movement of the wedge on the frame of the machine along a prescribed diagonal trajectory. In the preferred embodiment, the wedge has a work surface which slopes in one direction and a pair of side shoulders which slope in an opposite direction. The shoulders ride on guide bearings mounted on the frame of the machine.

BRIEF DESCRIPTION OF THE DRAWINGS

FIG. 7 is a partial view, similar to FIG. 2, showing the positions of the ram and wedge at the end of the ram's forward stroke; and FIG. 8 shows the trajectory of the wedge's guide shoulder riding between guide bearings.

DETAILED DESCRIPTION OF A PREFERRED EMBODIMENT

Figure 1:
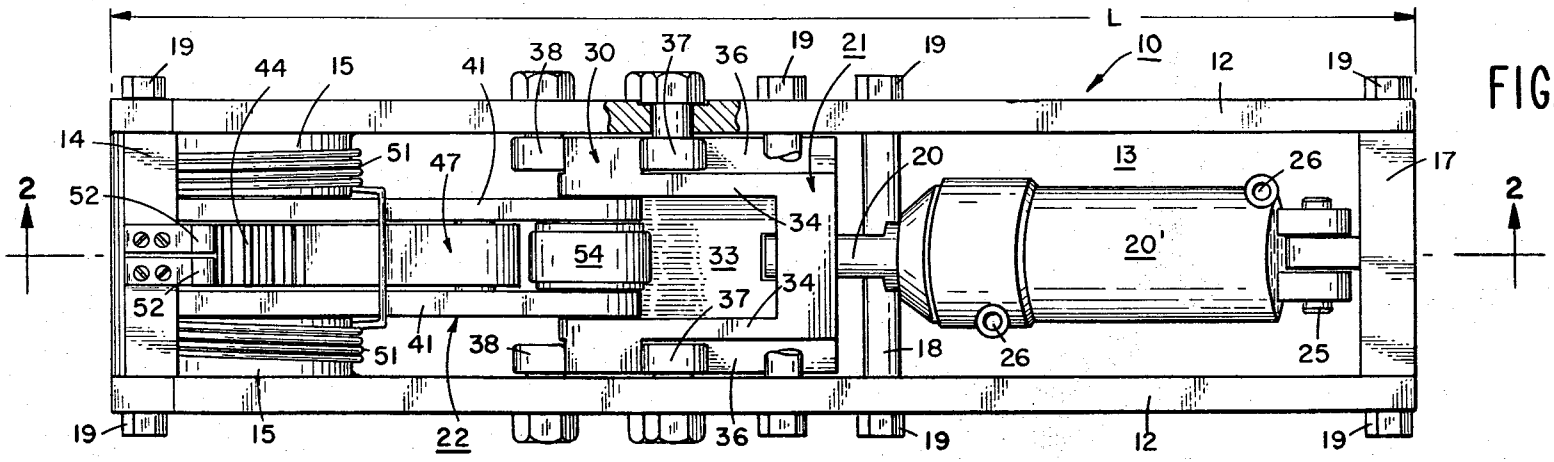
FIG. 1 is a top view of the novel, compact power wrenching machine.

With reference to the drawings, and especially FIGS. 1 through 4 thereof, there is shown a preferred embodiment of the compact power wrenching machine, generally designated as 10. It comprises an elongated, rigid frame 11 having a length dimension L which is considerably greater than its height dimension H, that is, it has a relatively small H/L ratio.

Frame 11 consists of two longitudinally-spaced narrow plates 12 forming therebetween an open longitudinal channel 13. Each plate 12 and the attachments thereto is the mirror image of the other plate 12 relative to a plane of symmetry containing line 2—2 of FIG. 1.

The forward ends of plates 12 are interconnected by a transverse end wall 14 and are provided with internally-facing sleeves 15 having coaxial cylindrical bores 16. The rear ends of plates 12 are interconnected by a transverse end wall 17. On intermediate end walls 14 and 17 are mounted one or more rods 18 to further increase the rigidity of frame 11. End walls 14, 17 and reinforcing rods 18 are secured to the side plates 12 by bolts 19.

Symmetrically within channel 13 are mounted in tandem three main sub-assemblies: a suitable force-producing source 20', a suitable wrench 22, and a mechanism 21 for transferring the force from source 20′ to wrench 22.

Source 20′ is preferably a hydraulic cylinder which is pivotably mounted on end wall 17 for rotation about a transverse pivot 25. Cylinder 20′ has a pair of fluid lines (not shown) connected to inlet/outlet ports 26 and a double-acting piston (not shown) that drives a ram 20.

Wrench 22 is preferably a ratchet wrench. Cylinder 20′ and wrench 22 are of conventional construction.

Figure 6:
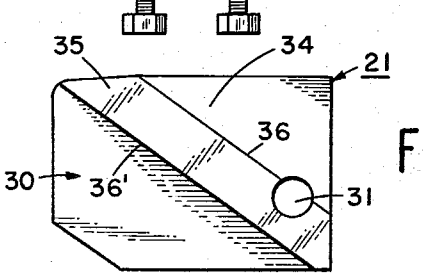
FIG. 6 is a front view of the wedge taken on line 6—6 of FIG. 4.
Figure 5:
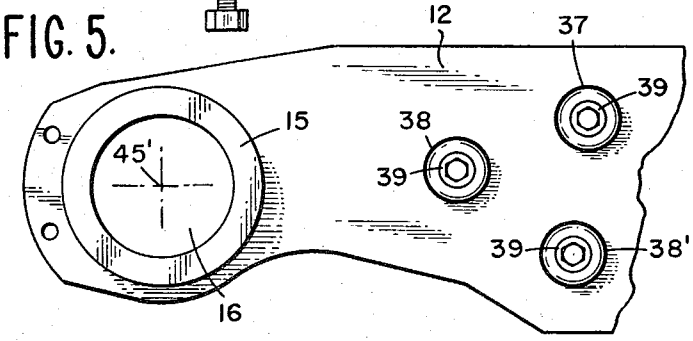
FIG. 5 is a partial rear view, taken on line 5—5 of FIG. 4, of one plate of the frame.

Mechanism 21 is preferably a wedge 30 which is made of a strong material, such as stainless steel, so as to withstand the loads imposed thereon. The rear end of wedge 30 has a transverse bore 31 and a pivot pin 32 which pivotably connects with ram 20. Wedge 20 has a top center work surface 33, preferably sloping forwardly and downwardly, between a pair of upright walls 34. The external side of each wall 34 has a shoulder 35 having a top flat surface 36 and a parallel bottom surface 36′, both sloping rearwardly and downwardly (FIG. 6). Surface 36 rides on a top bearing 37 (FIG. 5) and surface 36′ rides on a pair of spaced-apart bottom bearings 38, 38′. All bearings are rotatably mounted on studs 39. Thus, shoulders 35 are rollably mounted on side plates 12 to force wedge 30 to move diagonally (FIG. 8) along a prescribed linear trajectory defined by the guide bearings.

Ratchet wrench 22 comprises two longitudinally-spaced, parallel side walls 41 whose forward end portions have partial annular segments 41*a* defining cylindrical bores 41*b*. A ratchet wheel 42 has a pair of outer coaxial hubs 43 which are freely rotatable within bores 16 and 41*b*. Wheel 42 has identical teeth 44 on its outer cylindrical periphery and an axial socket 45 which is suitably shaped to receive the head of a threaded member, such as a nut or bolt, or of a drive member of another socket (not shown). The output torque of machine 10 is through socket 45.

The annular segments 41*a* preferably have an outer diameter which is nearly equal to the outer diameter of ratchet wheel 42. A pawl 47 has a base 47*a* pivotally mounted on a transverse pivot 48 supported by side plates 41. Thus, side plates 41 form a pawl holder. Pawl 47 has a pawl foot 49 having teeth 49′ which mesh with teeth 44. As thus far described, ratchet wrench 22 is of conventional construction and operation.

For the purpose of machine 10, ratchet wrench 22 is modified by rotatably mounting a work roller 54 on a transverse shaft 55 between the outer ends of side walls 41. Roller 54 is adapted to roll over the sloping work surface 33.

A torsion spring is wrapped around hubs 43, engages pawl 47, and is anchored to end wall 14 by screws 51*a*. Spring 51 maintains the teeth 49′ in engagement with teeth 44 and ensures continuous rolling contact between roller 54 and surface 33. One or more light retainer springs 52 are provided for preventing accidental rotation of wheel 43.

In the use of machine 10, during each work cycle, ram 20 exerts a push force 61 (FIG. 4) and an opposite pull force 62 in a substantially longitudinal or lengthwise direction L. The positions of ram 20 and of wedge 30 when the ram is fully contracted are shown in FIG. 2, and when it is fully extended are shown in FIG. 7.

As ram 20 extends, shoulders 35 ride up (as viewed in FIG. 7) in a forward diagonal direction 63 causing work surface 33 to also move upwardly and forwardly under roller 54. The movement of wedge 30, as a whole, has a longitudinal or lengthwise component and a lateral or height component, thereby producing a resultant diagonal displacement in the direction 63. The center 55′ of shaft 55 will rotate counterclockwise on an arcuate trajectory 55′*a* (FIG. 7) having for its center the center 45′ 0f wheel 43. The magnitude of this angular rotation will depend on the angles relative to the horizontal of the sloping surfaces 33 and 36.

In one embodiment, when ram 20 extends one centimeter in the longitudinal direction, roller 54 moves counterclockwise about one centimeter in the lateral direction. Thus, the push force 61 of ram 20 is transferred by wedge 30 into counterclockwise rotation of plates 41. Pawl 47 makes socket 45 to rotate also counterclockwise, because teeth 44 remain in engagement with teeth 49′.

Figure 2:
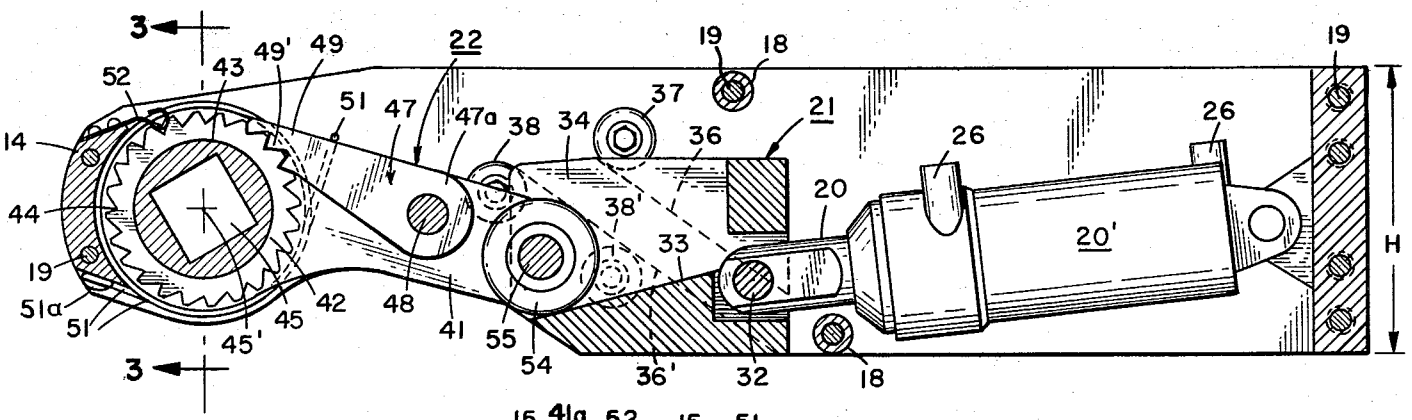
FIG. 2 is a view, partly in section, of the machine taken along line 2—2 of FIG. 1.
Figure 3:
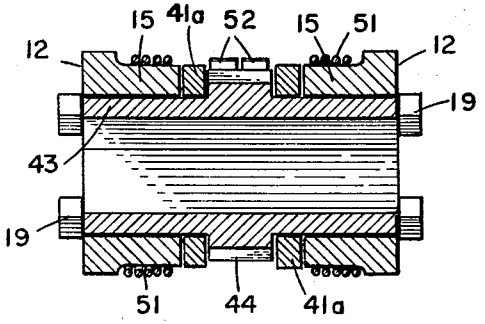
FIG. 3 is a sectional view of the ratchet wheel taken on line 3—3 of FIG. 2.
Figure 4:
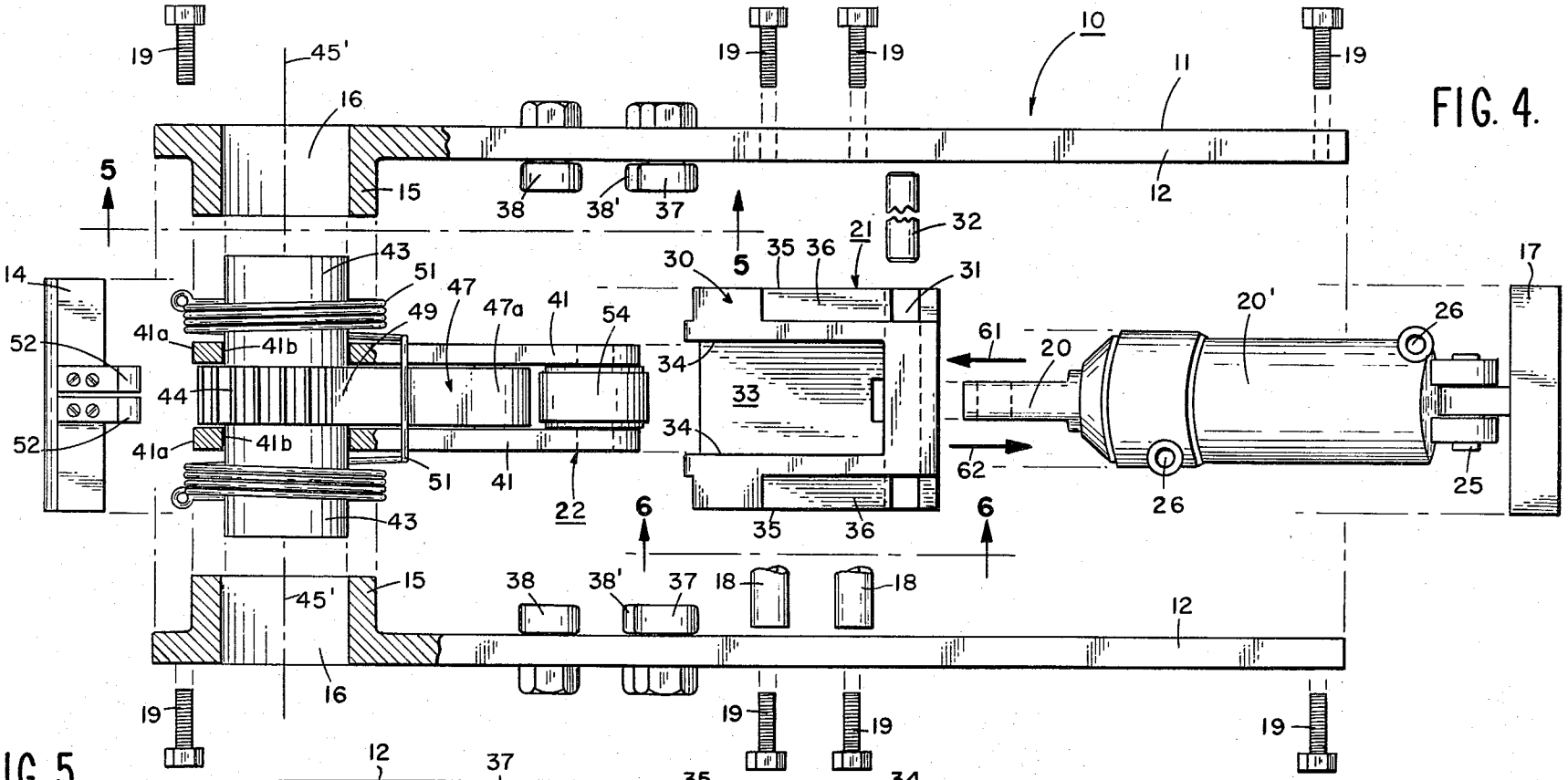
FIG. 4 is an exploded top view of the machine.

During the pull stroke 62 of ram 20, shoulders 35 ride down in the direction 64 (FIG. 8) on bearings 37, 38, 38′, and wedge 30 returns to its initial position shown in FIG. 2, which completes one full cycle. As a result, wrench 22 will rotate clockwise, but such rotation will not be transmitted to socket 45 because the teeth 49′ of pawl 47 disengage from teeth 44 of ratchet wheel 42.

The forces generated by ram 20, wedge 30, and wrench 22 require internal reaction forces that are developed by the end walls 14, 17, side plates 12, and sleeves 15.

Thus, wedge 30 makes it possible for the longitudinal axis of ram 20 to be in substantial tandem alignment with the longitudinal axis of wrench 22 in the length direction L of frame 11.

In the known wrenching machines, it was felt that these longitudinal axes had to be substantially perpendicular.

Because of this novel tandem alignment, the height H of machine 10 can be made relatively small compared to the length of wrench 22.

What is claimed is:

1. In a torque wrench including an elongated rigid frame; a force-producing actuator coupled to one portion of said frame; a wrench rotatably mounted on another portion of said frame and being longitudinally spaced from said actuator; a torque applicator having a roller at one end thereof and extending longitudinally from said wrench toward said actuator; a thrust block movably mounted on said frame between said actuator and said applicator, said block having a cam surface which slopes in one direction relative to the longitudinal axis of said frame; and said roller riding on said cam surface; the improvement, wherein:

said thrust block having two parallel shoulders on the opposite sides thereof, said shoulders sloping in a direction, relative to the longitudinal axis of said frame, which is opposite to the direction of said cam surface; and bearing means mounted on said frame to captivate said shoulders therebetween and to cause said block to gradually and simultaneously move longitudinally and transversely, when said block is acted upon by said actuator, to thereby rotate said applicator and said wrench.

2. The wrench of claim 1 wherein said actuator is a double-acting cylinder having a ram pivotably coupled to one end of said block, and the cylinder being pivotably coupled to said frame, whereby the cylinder pivots about its pivot axis as the block moves along its trajectory, and the rotation of said wrench is determined by the angles of inclination of said shoulders and of said cam surface relative to said longitudinal axis.

3. The wrench of claim 2 wherein, said cam surface is disposed centrally and internally on said block to impart transverse forces to said roller and to said torque applicator, thereby transforming the reciprocating linear movements of said ram into an intermittent reciprocating rotational movement by said wrench.

4. The wrench of claim 3 wherein said cam surface has an acute angle and said trajectory has an acute angle.

5. A power wrenching machine, comprising:

an elongated rigid frame;

a hydraulically-operated ram;

a wrench having a torque arm extending toward said ram;

a thrust block for applying a force to said arm thereby imparting a torque to said wrench;

guide members secured to the frame to form an inclined track therebetween, the guide members supporting and guiding said thrust block on the frame along said inclined track in a longitudinal and transverse direction; and said ram being pivotably mounted near one end of said frame, said wrench being rotatably mounted near the opposite end of said frame, said block being movably mounted on said frame and being movably coupled to said ram, and said block transferring high forces from said ram to said torque arm, thereby rotating said wrench about an axis transversely to the longitudinal axis of said frame, whereby the reciprocating linear longitudinal movements of said ram become translated into intermittent reciprocating rotational movements by said wrench, as the thrust block moves on said frame relative to said wrench arm.

* * * * *